US007954401B2

(12) United States Patent
Hall et al.

(10) Patent No.: US 7,954,401 B2
(45) Date of Patent: Jun. 7, 2011

(54) METHOD OF ASSEMBLING A DRILL BIT WITH A JACK ELEMENT

(75) Inventors: David R. Hall, Provo, UT (US); Francis E. Leany, Salem, UT (US); Joe Fox, Spanish Fork, UT (US); Tyson J. Wilde, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 749 days.

(21) Appl. No.: 11/553,651

(22) Filed: Oct. 27, 2006

(65) Prior Publication Data

US 2008/0099243 A1 May 1, 2008

(51) Int. Cl.
*B21K 5/04* (2006.01)

(52) U.S. Cl. ..... 76/108.2; 76/108.1

(58) Field of Classification Search ..... 76/108.1, 76/108.2, 108.4

See application file for complete search history.

(56) References Cited

U.S. PATENT DOCUMENTS

| | | | |
|---|---|---|---|
| 616,118 | A | 12/1889 | Kunhe |
| 465,103 | A | 12/1891 | Wegner |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,372,257 | A | 3/1921 | Swisher |
| 1,387,733 | A | 8/1921 | Midgett |
| 1,460,671 | A | 7/1923 | Hebsacker |
| 1,544,757 | A | 7/1925 | Hufford |
| 1,746,455 | A | 2/1930 | Woodruff |
| 2,169,223 | A | 8/1931 | Christian |
| 1,821,474 | A | 9/1931 | Mercer |
| 1,836,638 | A | 12/1931 | Wright |
| 1,879,177 | A | 9/1932 | Gault |
| 2,022,101 | A | 11/1935 | Wright |
| 2,054,255 | A | 9/1936 | Howard |
| 2,064,255 | A | 12/1936 | Garfield |
| 2,100,692 | A | 11/1937 | Harman |
| 2,199,692 | A | 5/1940 | Catland |
| 2,218,130 | A | 10/1940 | Court |
| 2,227,233 | A | 12/1940 | Scott et al. |
| 2,320,136 | A | 5/1943 | Kammerer |
| 2,345,024 | A | 3/1944 | Bannister |
| 2,375,335 | A | 5/1945 | Walker |
| 2,466,991 | A | 4/1949 | Kammerer |

(Continued)

OTHER PUBLICATIONS

PCT/US06/43125, International Search Report dated May 27, 2008.

(Continued)

*Primary Examiner* — Hwei-Siu C Payer

(74) *Attorney, Agent, or Firm* — Holme Roberts & Owens LLP

(57) ABSTRACT

A method of assembling a drill bit with a jack element that includes obtaining a bit body intermediate a shank and a working face, with the working face including a plurality of blades having of at least one cutting element and a receptacle formed proximate a center of the working face. The method further includes attaching a pocket having a central hollow within the receptacle, and securing the jack element within the central hollow with a press fit such that the centerline of the jack element is substantially coaxial with the axis of rotation of the drill bit.

23 Claims, 10 Drawing Sheets

U.S. PATENT DOCUMENTS

| | | | | |
|---|---|---|---|---|
| 2,540,464 | A | | 2/1951 | Stokes |
| 2,544,036 | A | | 3/1951 | Kammerer |
| 2,575,173 | A | | 11/1951 | Johnson |
| 2,578,593 | A | | 12/1951 | Phipps |
| 2,619,325 | A | | 11/1952 | Arutunoff |
| 2,626,780 | A | | 1/1953 | Ortloff |
| 2,643,860 | A | | 6/1953 | Koch |
| 2,725,215 | A | | 11/1955 | Macneir |
| 2,746,721 | A | | 5/1956 | Moore |
| 2,755,071 | A | | 7/1956 | Kammerer |
| 2,776,819 | A | | 1/1957 | Brown |
| 2,807,443 | A | | 9/1957 | Wyman |
| 2,819,041 | A | | 1/1958 | Beckham |
| 2,819,043 | A | | 1/1958 | Henderson |
| 2,838,284 | A | | 6/1958 | Austin |
| 2,868,511 | A | | 1/1959 | Barrett |
| 2,873,093 | A | | 2/1959 | Hilderbrandt |
| 2,877,984 | A | | 3/1959 | Causey |
| 2,894,722 | A | | 7/1959 | Buttolph |
| 2,901,223 | A | | 8/1959 | Scott |
| 2,942,850 | A | | 6/1960 | Heath |
| 2,942,851 | A | | 6/1960 | Beck |
| 2,963,102 | A | | 12/1960 | Smith |
| 2,998,085 | A | | 8/1961 | Dulaney |
| 3,055,443 | A | | 9/1962 | Edwards |
| 3,058,532 | A | | 10/1962 | Alder |
| 3,059,708 | A | | 10/1962 | Cannon |
| 3,075,592 | A | | 1/1963 | Overly |
| 3,077,936 | A | | 2/1963 | Arutunoff |
| 3,135,341 | A | | 6/1964 | Ritter |
| 3,139,147 | A | | 6/1964 | Hays |
| 3,199,617 | A | | 8/1965 | White |
| 3,294,186 | A | | 12/1966 | Buell |
| 3,301,339 | A | | 1/1967 | Pennebaker |
| 3,346,060 | A | | 10/1967 | Beyer |
| 3,379,264 | A | | 4/1968 | Cox |
| 3,387,673 | A | | 6/1968 | Thompson |
| 3,429,390 | A | | 2/1969 | Bennett |
| 3,433,331 | A | | 3/1969 | Heyberger |
| 3,455,158 | A | | 7/1969 | Richter |
| 3,493,165 | A | | 2/1970 | Schorfield |
| 3,583,504 | A | | 6/1971 | Aalund |
| 3,635,296 | A | | 1/1972 | Lebourg |
| 3,688,852 | A | | 9/1972 | Gaylord |
| 3,764,493 | A | | 10/1973 | Rosar |
| 3,765,493 | A | | 10/1973 | Rosar et al. |
| 3,807,512 | A | | 4/1974 | Pogonowski |
| 3,815,692 | A | | 6/1974 | Varley |
| 3,821,993 | A | | 7/1974 | Kniff |
| 3,885,638 | A | | 5/1975 | Skidmore |
| 3,955,635 | A | | 5/1976 | Skidmore |
| 3,960,223 | A | | 6/1976 | Kleine |
| 3,989,114 | A | | 11/1976 | Tschirky |
| 4,081,042 | A | | 3/1978 | Johnson |
| 4,096,917 | A | | 6/1978 | Harris |
| 4,106,577 | A | | 8/1978 | Summers |
| 4,165,790 | A | * | 8/1979 | Emmerich ..... 175/420.1 |
| 4,176,723 | A | | 12/1979 | Arceneaux |
| 4,186,628 | A | | 2/1980 | Bonnice |
| 4,207,964 | A | | 6/1980 | Taguchi |
| 4,253,533 | A | | 3/1981 | Baker |
| 4,262,758 | A | | 4/1981 | Evans |
| 4,280,573 | A | | 7/1981 | Sudnishnikov |
| 4,304,312 | A | | 12/1981 | Larsson |
| 4,307,786 | A | | 12/1981 | Evans |
| 4,386,669 | A | | 6/1983 | Evans |
| 4,397,361 | A | | 8/1983 | Langford |
| 4,416,339 | A | | 11/1983 | Baker |
| 4,445,580 | A | | 5/1984 | Sahley |
| 4,448,269 | A | | 5/1984 | Ishikawa |
| 4,478,296 | A | | 10/1984 | Richman |
| 4,499,795 | A | | 2/1985 | Radtke |
| 4,531,592 | A | | 7/1985 | Hayatdavoudi |
| 4,535,853 | A | | 8/1985 | Ippolito |
| 4,538,691 | A | | 9/1985 | Dennis |
| 4,566,545 | A | | 1/1986 | Story |
| 4,574,895 | A | | 3/1986 | Dolezal |
| 4,583,592 | A | | 4/1986 | Gazda |
| 4,597,454 | A | | 7/1986 | Schoeffler |
| 4,612,987 | A | | 9/1986 | Cheek |
| 4,615,399 | A | | 10/1986 | Schoeffler |
| 4,624,306 | A | | 11/1986 | Traver |
| 4,637,479 | A | | 1/1987 | Leising |
| 4,640,374 | A | | 2/1987 | Dennis |
| 4,679,637 | A | | 7/1987 | Cherrington |
| 4,694,913 | A | | 9/1987 | McDonald |
| 4,732,226 | A | | 3/1988 | Ebeling |
| 4,733,734 | A | | 3/1988 | Bardin |
| 4,775,017 | A | | 10/1988 | Forrest |
| 4,817,739 | A | | 4/1989 | Jeter |
| 4,821,819 | A | * | 4/1989 | Whysong ..... 299/113 |
| 4,852,672 | A | | 8/1989 | Behrens |
| 4,858,706 | A | | 8/1989 | Lebourgh |
| 4,875,531 | A | | 10/1989 | Biehl |
| 4,889,017 | A | | 12/1989 | Fuller |
| 4,962,822 | A | | 10/1990 | Pascale |
| 4,974,688 | A | | 12/1990 | Helton |
| 4,979,577 | A | | 12/1990 | Walter |
| 4,981,184 | A | | 1/1991 | Knowlton |
| 4,991,670 | A | | 2/1991 | Fuller |
| 5,009,273 | A | | 4/1991 | Grabinski |
| 5,027,914 | A | | 7/1991 | Wilson |
| 5,038,873 | A | | 8/1991 | Jurgens |
| 5,088,568 | A | | 2/1992 | Simuni |
| 5,094,304 | A | | 3/1992 | Briggs |
| 5,103,919 | A | | 4/1992 | Warren |
| 5,119,892 | A | | 6/1992 | Clegg |
| 5,135,060 | A | | 8/1992 | Ide |
| 5,141,063 | A | | 8/1992 | Quesenbury |
| 5,148,875 | A | | 9/1992 | Karlsson |
| 5,176,212 | A | | 1/1993 | Tandberg |
| 5,186,268 | A | | 2/1993 | Clegg |
| 5,193,628 | A | | 3/1993 | Hill |
| 5,222,566 | A | | 6/1993 | Taylor |
| 5,255,749 | A | | 10/1993 | Bumpurs |
| 5,259,469 | A | | 11/1993 | Stjernstrom |
| 5,265,682 | A | | 11/1993 | Russell |
| 5,311,953 | A | | 5/1994 | Walker |
| 5,361,859 | A | | 11/1994 | Tibbitts |
| 5,388,649 | A | | 2/1995 | Ilomaki |
| 5,410,303 | A | | 4/1995 | Comeau |
| 5,417,292 | A | | 5/1995 | Polakoff |
| 5,423,389 | A | | 6/1995 | Warren |
| 5,443,128 | A | | 8/1995 | Amaudric du Chaffaut |
| 5,475,309 | A | | 12/1995 | Hong |
| 5,507,357 | A | | 4/1996 | Hult |
| 5,553,678 | A | | 9/1996 | Barr |
| 5,560,440 | A | | 10/1996 | Tibbitts |
| 5,568,838 | A | | 10/1996 | Struthers |
| 5,655,614 | A | | 8/1997 | Azar |
| 5,678,644 | A | | 10/1997 | Fielder |
| 5,720,355 | A | | 2/1998 | Lamine |
| 5,732,784 | A | | 3/1998 | Nelson |
| 5,758,732 | A | | 6/1998 | Liw |
| 5,778,991 | A | | 7/1998 | Runquist |
| 5,794,728 | A | | 8/1998 | Palmberg |
| 5,896,938 | A | | 4/1999 | Moeny |
| 5,901,113 | A | | 5/1999 | Masak |
| 5,904,444 | A | | 5/1999 | Kabeuchi |
| 5,947,215 | A | | 9/1999 | Lundell |
| 5,950,743 | A | | 9/1999 | Cox |
| 5,957,223 | A | | 9/1999 | Doster |
| 5,957,225 | A | | 9/1999 | Sinor |
| 5,967,247 | A | | 10/1999 | Pessier |
| 5,979,571 | A | | 11/1999 | Scott |
| 5,992,547 | A | | 11/1999 | Caraway |
| 5,992,548 | A | | 11/1999 | Silva |
| 6,021,859 | A | | 2/2000 | Tibbitts |
| 6,039,131 | A | | 3/2000 | Beaton |
| 6,047,239 | A | | 4/2000 | Berger |
| 6,050,350 | A | | 4/2000 | Morris |
| 6,131,675 | A | | 10/2000 | Anderson |
| 6,150,822 | A | | 11/2000 | Hong |
| 6,161,631 | A | | 12/2000 | Kennedy |
| 6,186,251 | B1 | | 2/2001 | Butcher |
| 6,202,761 | B1 | | 3/2001 | Forney |
| 6,213,225 | B1 | * | 4/2001 | Chen ..... 175/57 |

| | | | |
|---|---|---|---|
| 6,213,226 | B1 | 4/2001 | Eppink |
| 6,223,824 | B1 | 5/2001 | Moyes |
| 6,269,893 | B1 | 8/2001 | Beaton |
| 6,296,069 | B1 | 10/2001 | Lamine |
| 6,321,858 | B1 | 11/2001 | Wentworth |
| 6,340,064 | B2 | 1/2002 | Fielder |
| 6,364,034 | B1 | 4/2002 | Schoeffler |
| 6,364,038 | B1 | 4/2002 | Driver |
| 6,394,200 | B1 | 5/2002 | Watson |
| 6,439,326 | B1 | 8/2002 | Huang |
| 6,450,269 | B1 | 9/2002 | Wentworth |
| 6,467,341 | B1 | 10/2002 | Boucher |
| 6,474,425 | B1 | 11/2002 | Truax |
| 6,484,819 | B1 | 11/2002 | Harrison |
| 6,484,825 | B2 | 11/2002 | Watson |
| 6,510,906 | B1 | 1/2003 | Richert |
| 6,513,606 | B1 | 2/2003 | Krueger |
| 6,533,050 | B2 | 3/2003 | Molloy |
| 6,594,881 | B2 | 7/2003 | Tibbitts |
| 6,601,454 | B1 | 8/2003 | Botnan |
| 6,622,803 | B2 | 9/2003 | Harvey |
| 6,668,949 | B1 | 12/2003 | Rives |
| 6,698,537 | B2 | 3/2004 | Pascale |
| 6,729,420 | B2 | 5/2004 | Mensa-Wilmot |
| 6,732,817 | B2 | 5/2004 | Dewey |
| 6,789,635 | B2 | 9/2004 | Wentworth |
| 6,822,579 | B2 | 11/2004 | Goswami |
| 9,629,076 | | 4/2005 | Fanuel |
| 6,929,076 | B2 | 8/2005 | Fanuel et al. |
| 6,948,572 | B2 | 9/2005 | Hay |
| 6,953,096 | B2 | 10/2005 | Gledhill |
| 7,096,980 | B2 | 8/2006 | Trevas |
| 7,198,119 | B1 | 4/2007 | Hall |
| 7,225,886 | B1 | 6/2007 | Hall |
| 7,240,744 | B1 | 7/2007 | Kemick |
| 7,258,179 | B2 | 8/2007 | Hall |
| 7,270,196 | B2 | 9/2007 | Hall |
| 7,337,858 | B2 | 3/2008 | Hall |
| 7,360,610 | B2 | 4/2008 | Hall |
| 7,398,837 | B2 | 7/2008 | Hall |
| 7,419,018 | B2 | 9/2008 | Hall |
| 7,426,968 | B2 | 9/2008 | Hall |
| 7,497,279 | B2 | 3/2009 | Hall |
| 7,506,701 | B2 | 3/2009 | Hall |
| 7,533,737 | B2 | 5/2009 | Hall |
| 7,571,780 | B2 | 8/2009 | Hall |
| 7,617,886 | B2 | 11/2009 | Hall |
| 7,641,002 | B2 | 1/2010 | Hall |
| 7,661,487 | B2 | 2/2010 | Hall |
| 7,694,756 | B2 | 4/2010 | Hall |
| 2001/0031178 | A1 | 10/2001 | Remke |
| 2003/0213621 | A1 | 11/2003 | Britten |
| 2004/0222024 | A1 | 11/2004 | Edscer |
| 2004/0238221 | A1 | 12/2004 | Runia |
| 2004/0256155 | A1 | 12/2004 | Kriesels |
| 2009/0260894 | A1 | 10/2009 | Hall |
| 2010/0000799 | A1 | 1/2010 | Hall |
| 2010/0065334 | A1 | 3/2010 | Hall |

OTHER PUBLICATIONS

PCT/US06/43125, Written Opinion dated May 27, 2008.
PCT/US07/64539, International Search Report and Written Opinion dated Jun. 16, 2008.
PCT/US07/64544, International Search Report dated Aug. 5, 2008.
PCT/US07/64544, Written Opinion dated Aug. 5, 2008.

* cited by examiner

METHOD OF ASSEMBLING A DRILL BIT WITH A JACK ELEMENT

BACKGROUND OF THE INVENTION

This invention relates to drill bits, specifically drill bit assemblies for use in oil, gas and geothermal drilling. Drill bits are continuously exposed to harsh conditions during drilling operations in the earth's surface. Bit whirl in hard formations for example may result in damage to the drill bit and reduce penetration rates. Further loading too much weight on the drill bit when drilling through a hard formation may exceed the bit's capabilities and also result in damage. Too often unexpected hard formations are encountered suddenly and damage to the drill bit occurs before the weight on the drill bit may be adjusted. When a bit fails it reduces productivity resulting in diminished returns to a point where it may become uneconomical to continue drilling. The cost of the bit is not considered so much as the associated down time required to maintain or replace a worn or expired bit. To replace a bit requires removal of the drill string from the bore in order to service the bit which translates into significant economic losses until drilling can be resumed.

The prior art has addressed bit whirl and weight on bit issues. Such issues have been addressed in the U.S. Pat. No. 6,443,249 to Beuershausen, which is herein incorporated by reference for all that it contains. The '249 patent discloses a PDC-equipped rotary drag bit especially suitable for directional drilling. Cutter chamfer size and backrake angle, as well as cutter backrake, may be varied along the bit profile between the center of the bit and the gage to provide a less aggressive center and more aggressive outer region on the bit face, to enhance stability while maintaining side cutting capability, as well as providing a high rate of penetration under relatively high weight on bit.

U.S. Pat. No. 6,298,930 to Sinor which is herein incorporated by reference for all that it contains, discloses a rotary drag bit including exterior features to control the depth of cut by cutters mounted thereon, so as to control the volume of formation material cut per bit rotation as well as the torque experienced by the bit and an associated bottomhole assembly. The exterior features preferably precede, taken in the direction of bit rotation, cutters with which they are associated, and provide sufficient bearing area so as to support the bit against the bottom of the borehole under weight on bit without exceeding the compressive strength of the formation rock.

U.S. Pat. No. 6,363,780 to Rey-Fabret which is herein incorporated by reference for all that it contains, discloses a system and method for generating an alarm relative to effective longitudinal behavior of a drill bit fastened to the end of a tool string driven in rotation in a well by a driving device situated at the surface, using a physical model of the drilling process based on general mechanics equations. The following steps are carried out: the model is reduced so to retain only pertinent modes, at least two values Rf and Rwob are calculated, Rf being a function of the principal oscillation frequency of weight on hook WOH divided by the average instantaneous rotating speed at the surface, Rwob being a function of the standard deviation of the signal of the weight on bit WOB estimated by the reduced longitudinal model from measurement of the signal of the weight on hook WOH, divided by the average weight on bit defined from the weight of the string and the average weight on hook. Any danger from the longitudinal behavior of the drill bit is determined from the values of Rf and Rwob.

U.S. Pat. No. 5,806,611 to Van Den Steen which is herein incorporated by reference for all that it contains, discloses a device for controlling weight on bit of a drilling assembly for drilling a borehole in an earth formation. The device includes a fluid passage for the drilling fluid flowing through the drilling assembly, and control means for controlling the flow resistance of drilling fluid in the passage in a manner that the flow resistance increases when the fluid pressure in the passage decreases and that the flow resistance decreases when the fluid pressure in the passage increases.

U.S. Pat. No. 5,864,058 to Chen which is herein incorporated by reference for all that is contains, discloses a downhole sensor sub in the lower end of a drillstring, such sub having three orthogonally positioned accelerometers for measuring vibration of a drilling component. The lateral acceleration is measured along either the X or Y axis and then analyzed in the frequency domain as to peak frequency and magnitude at such peak frequency. Backward whirling of the drilling component is indicated when the magnitude at the peak frequency exceeds a predetermined value. A low whirling frequency accompanied by a high acceleration magnitude based on empirically established values is associated with destructive vibration of the drilling component. One or more drilling parameters (weight on bit, rotary speed, etc.) is then altered to reduce or eliminate such destructive vibration.

BRIEF SUMMARY OF THE INVENTION

In one aspect of the invention the method has steps for forming a drill bit with an axis of rotation having a bit body intermediate a shank and a working face. The bit body has a working face with a plurality of blades that may extend outward from the bit body. The working face may comprise at least one cutting element disposed along the blades. A receptacle in the working face of the drill bit may be formed to accept a pocket that is coaxial to the axis of rotation. A jack element that is disposed within the pocket and extends from the working face of the drill bit within a range defined by the at least one cutting element proximate the axis of rotation.

In some embodiments the drill bit may be force balanced. The pocket may be brazed and then machined using a mill or lathe to ensure that the jack element is substantially coaxial with the axis of rotation when attached to the pocket. Portions of the at least one cutting element proximate the axis of rotation may be pre-flatted or ground flat in order to accommodate the jack element. The jack element may be brazed, press fit, bonded, welded or threaded into the pocket and protrude from the working face within a range defined by the cutting surface of the at least one cutting element proximate to the axis of rotation. Materials suitable for the at least one cutting element or jack element may be selected from the group consisting of diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, polished diamond, course diamond, fine diamond cubic boron nitride, chromium, titanium, aluminum, matrix, diamond impregnated matrix, diamond impregnated carbide, a cemented metal carbide, tungsten carbide, niobium, or combinations thereof. The jack element may have a distal end with a blunt geometry with a generally hemi-spherical shape, a generally flat shape, a generally conical shape, a generally round shape, a generally asymmetric shape, or combinations thereof.

DETAILED DESCRIPTION OF EXEMPLARY EMBODIMENTS

Figure 1:
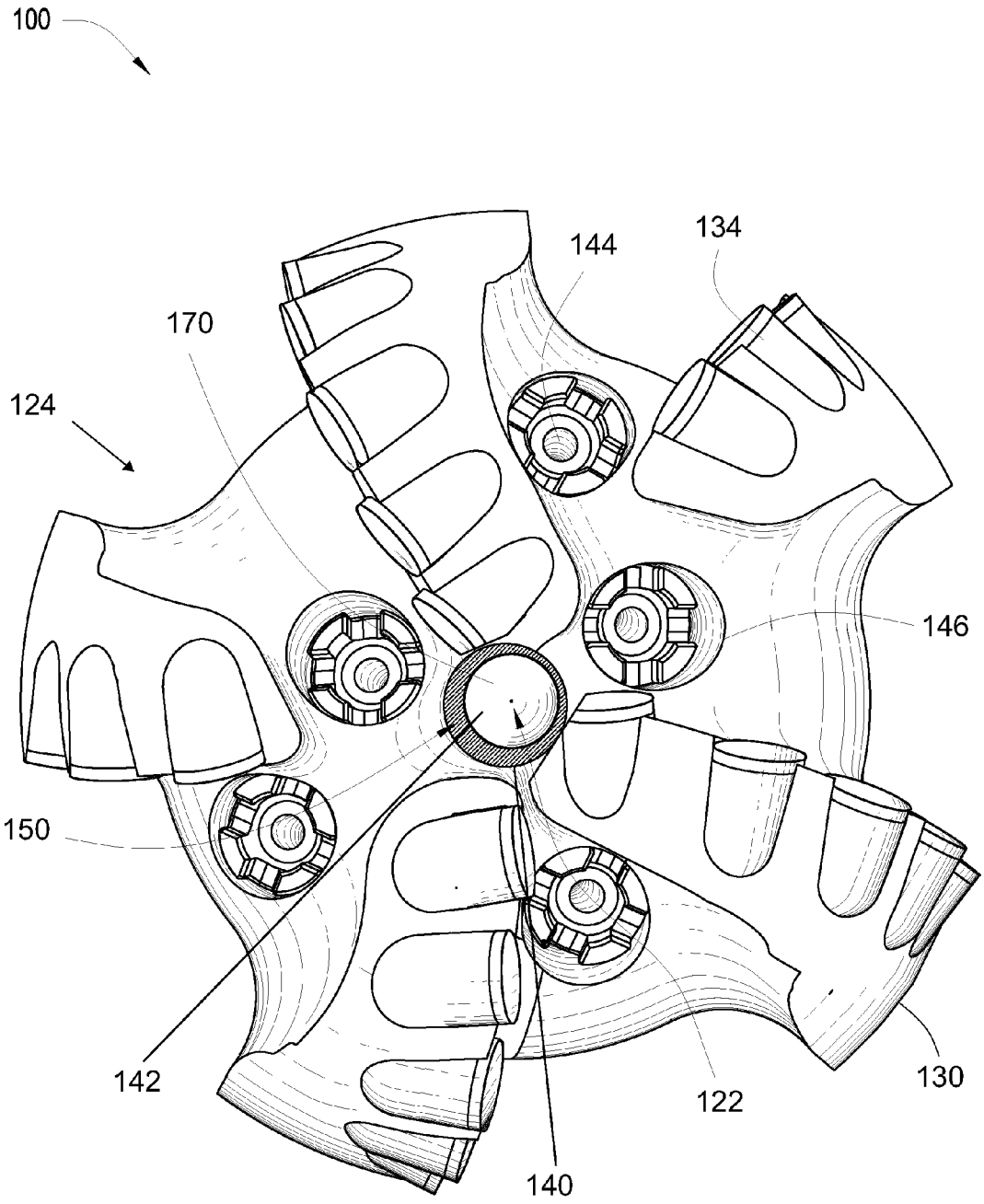
FIG. 1 is a perspective diagram of an embodiment of a drill bit assembly with a jack element.
Figure 2:
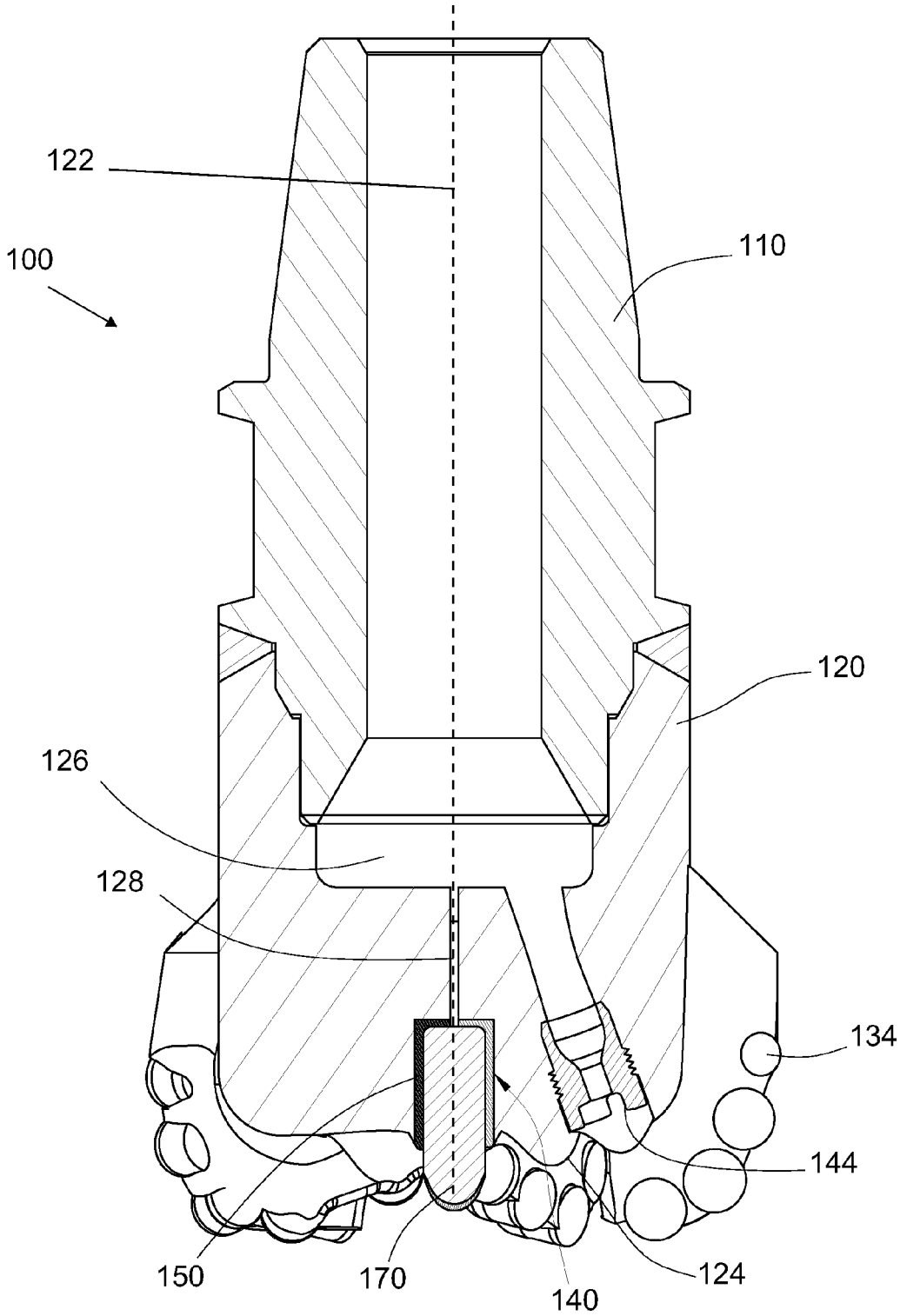
FIG. 2 is a cross sectional diagram of an embodiment of a drill bit assembly with a jack element.

FIGS. 1 and 2 disclose a drill bit 100 of the present invention. The drill bit 100 is formed to comprise a shank 110 which is adapted for connection to a downhole tool string. A bit body 120 is formed and attached to the shank 110 and comprises an end which forms a working face 124. A receptacle 140 is formed or molded into the working face 124 of the drill bit 100 and may be disposed substantially coaxial with the axis 122 of rotation of the drill bit 100. A pocket 150 which may comprise a material selected from the following including aluminum, titanium, steel, mild steel, hardened steel, stainless steel, a metallic alloy or combinations thereof, may be brazed within the receptacle 140 of the working face 124.

In some embodiments a centerline 142 of the receptacle 140 may not be substantially coaxial with the axis 122 of rotation of the drill bit 100. In other embodiments the working face 124 may form a raised buttress that encapsulates the receptacle 140 and protrudes from the center of the working face 124. A channel 128 may be formed and may extend from the receptacle 140 to a bore 126 within a portion of the bit body 120. The channel 128 may allow air to enter or exit the receptacle 140 when the jack element 170 is inserted or removed and prevent a suction effect.

A jack element 170 that may comprise of a material selected from the group consisting of gold, silver, a refractory metal, carbide, tungsten carbide, cemented metal carbide, niobium, titanium, platinum, molybdenum, diamond, cobalt, nickel, iron, cubic boron nitride, and combinations thereof, may be press fit within the pocket 150 such that it may be substantially coaxial with an axis 122 of rotation of the drill bit 100. The working face 124 may also comprise a plurality of blades 130 that are formed to extend outwardly from the bit body 120, each of which may also comprise at least one cutting element 134. Preferably the drill bit 100 will have between three and seven blades 130. In other embodiments the at least one cutting element 134 proximate the axis 122 of rotation of the drill bit 100 may also be pre-flatted or ground flat to accommodate the jack element 170. A plurality of nozzles 144 may also be fitted into recesses 146 formed or molded into the working face 124.

The incorporation of the pocket 150 allows the jack element 170 to be aligned with the axis 122 of rotation of the bit 100. Brazing requires heating, which causes the receptacle 140 to expand and then shrink when cooling. This shrinking may reorient the receptacle 140 such that it is angled or misaligned from the axis 122. By brazing the pocket 150 formed from shapeable material, such as steel, into the receptacle, and then shaping the pocket such that it is truly aligned with the axis 122 of rotation of the drill bit 100 allows the jack element to be press fit into the receptacle such that the centerline of the jack element is aligned with the axis of rotation. It has been found the jack element's life can greatly increase the closer the jack element is aligned with the axis of rotation of the bit. It has also been found that misalignment, such as that caused by shrinking induced during the cooling stage of brazing, can greatly reduce the life of the jack element.

Another advantage to press fitting a jack element 170 into the pocket 150 is to avoid brazing the jack element directly. The jack element may be subjected to high loads downhole and in some cases subjecting the jack to the heating and cooling required during brazing may damage the jack element.

Figure 3:
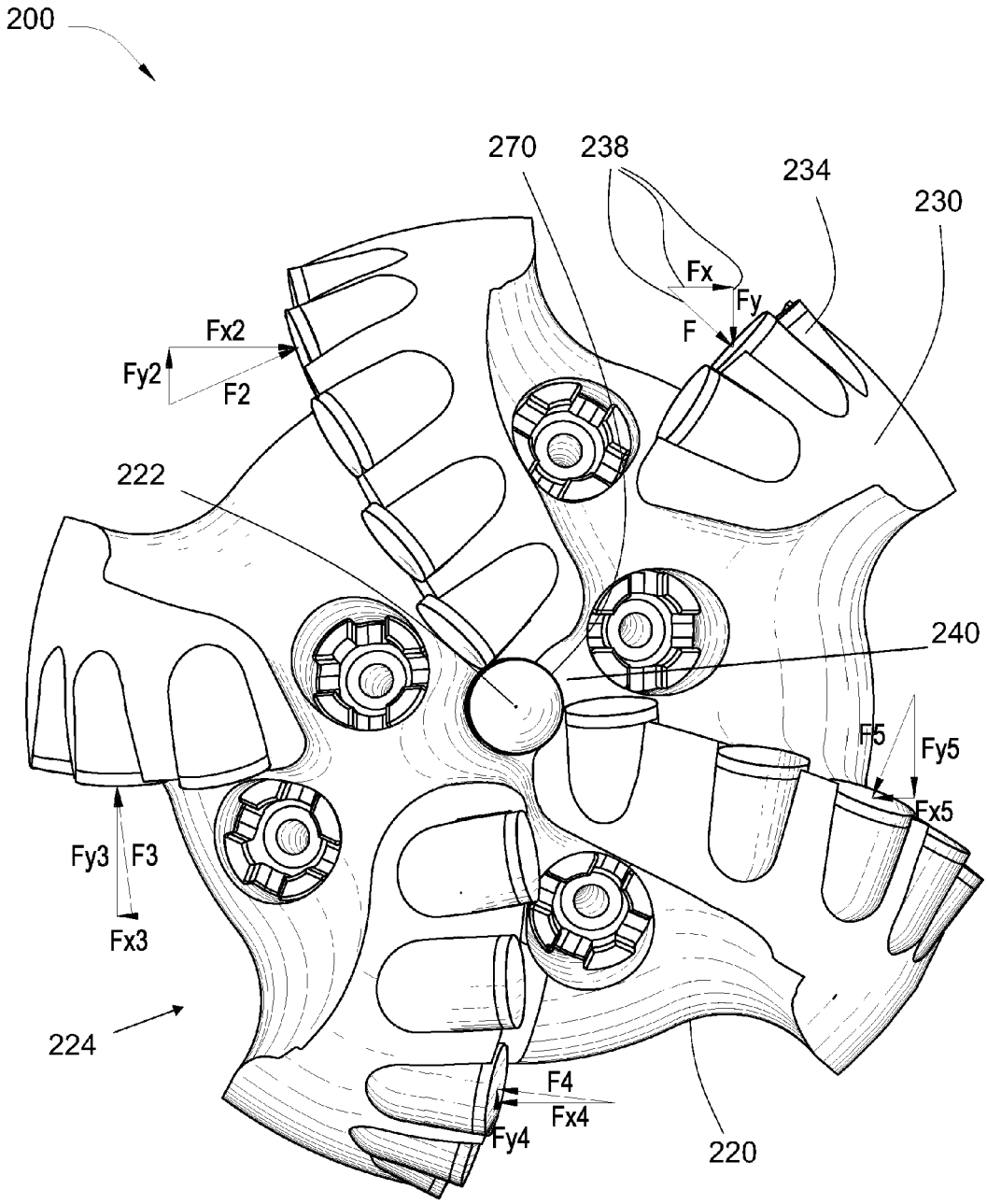
FIG. 3 is a perspective diagram of another embodiment of drill bit assembly depicting a force balanced bit.

FIG. 3 discloses a diagram of another embodiment of a drill bit 200 depicting the placement of the at least one cutting element 234 around the blades 230 so that the drill bit 200 may be force balanced. Vector calculations 238 may be used to calculate the placement the cutting elements 234 around the blades 230 so that the forces acting on the body 220 of the drill bit 200 while engaged in boring through the earth's formations are distributed substantially evenly over the working face 224 of the bit. Specifically the vector calculations 238 may be used to calculate horizontal torque and vertical weight on bit forces acting on the face of each cutting element 234. The calculations may then be used to determine the horizontal components of those forces to determine the net force imbalance. The cutting elements 234 may then be disposed around the blades 230 to help reduce the net force imbalance so that the bit has minimal side force when drilling. Mathematically this is represented by the equations;

$$SFx=Fx1+Fx2+Fx3+Fx4+Fx5=0$$

$$SFy=Fy1+Fy2+Fy3+Fy4+Fy5=0$$

This embodiment has proven to increase overall durability of drill bits and assists to prolong the life of the cutting elements 234. In other embodiments the vector calculations 238 may also be manipulated to determine optimal positioning of the jack element 270 before the receptacle 240 is formed into the working face 224 such that the receptacle 240 may be substantially coaxial to the axis 222 of rotation without adversely affecting the balance of the drill bit 200. For instance, the receptacle can be formed or molded into the working face and substantially coaxial with the axis of rotation of the drill bit prior to machining the receptacle to accept the pocket.

Figure 4:
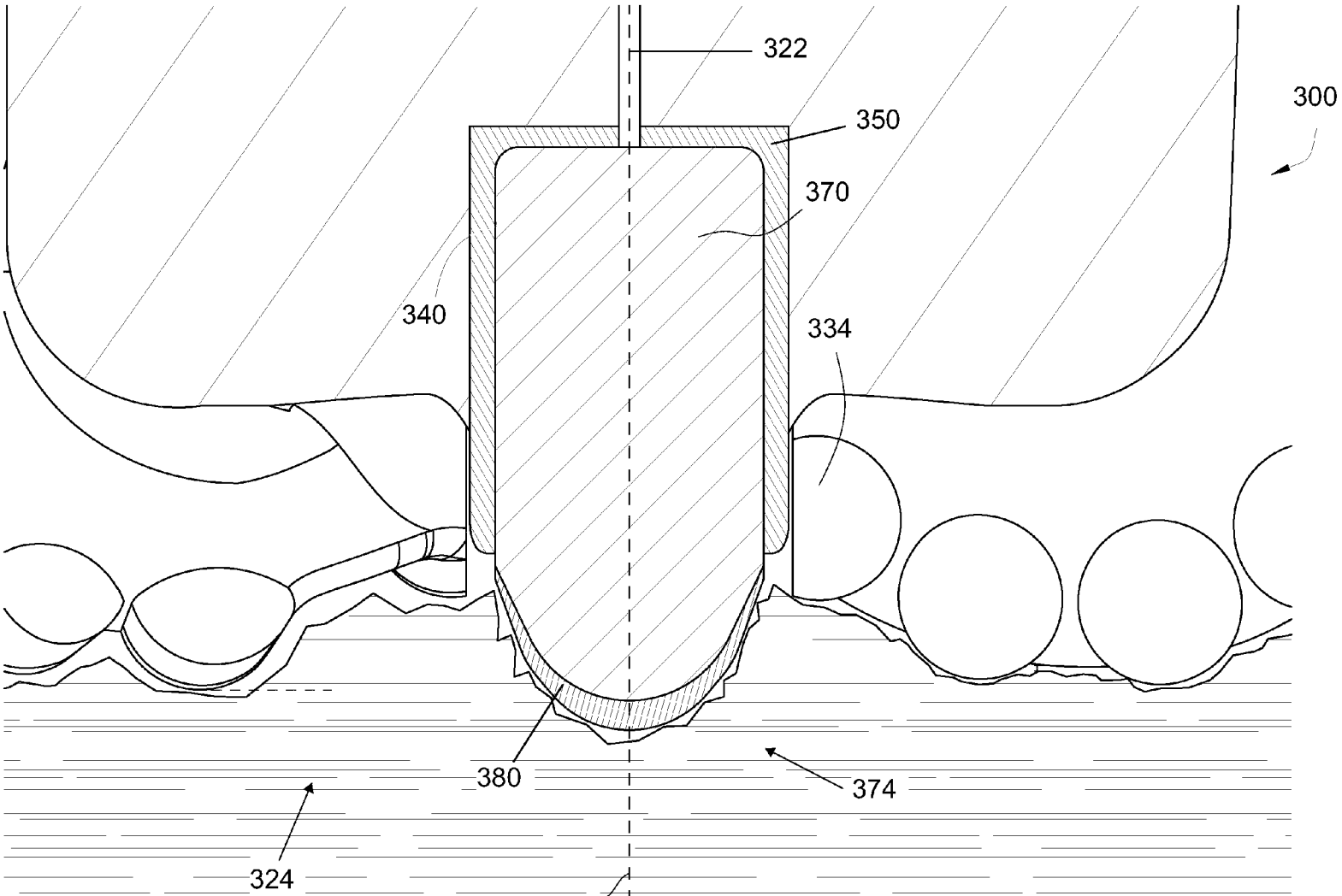
FIG. 4 is a cross sectional diagram of another embodiment of a drill bit assembly depicting at least one cutting element that is pre-flattened and a jack element.

FIG. 4 discloses a cross section of an embodiment of the drill bit 300 depicting how one or more cutting elements 334 disposed proximate the axis 322 of rotation of the drill bit 300 may be machined pre-flat during fabrication or ground flat after fabrication of the working face 324 such that there is sufficient space to install or accommodate both the pocket 350 and the jack element 370 within the receptacle 340 such that a centerline 372 of the jack element 370 may be substantially coaxial with the axis 322 of rotation of the drill bit 300. The cutting elements 334 may comprise of a polycrystalline diamond compact formed through the HPHT process with a diameter up to 2 inches and a thickness of at least 0.250 inches. In some embodiments, the distal end 374 of the jack element 370 includes a cubic boron nitride or other ceramic compact 380 to prevent wear.

Figure 5:
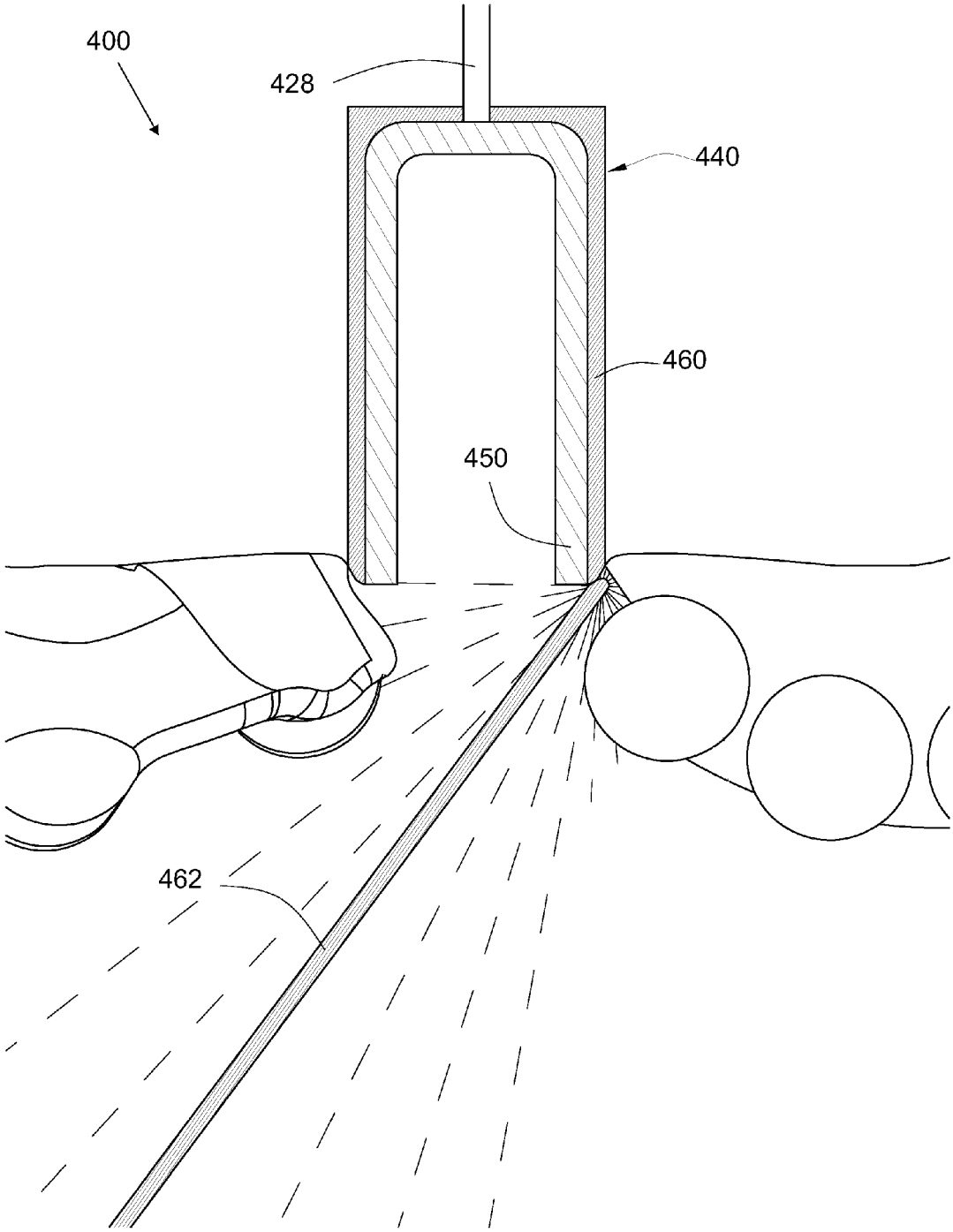
FIG. 5 is a perspective diagram of an embodiment of drill bit assembly depicting a method of brazing.

FIG. 5 discloses a cross section of an embodiment of the drill bit 400 wherein the pocket 450 may be brazed into the receptacle 440 of the drill bit 400 using an alloy rod 462 to provide filler 460 to bond the two elements together. In other embodiments the filler 460 may also comprise of a tape, foil or preform. In other embodiments, the pocket 450 can be attached into the receptacle 440 through oven brazing. The filler 460 may be selected from the group consisting of copper, silver, nickel, aluminum, gold, tin, zinc, a refractory metal, carbide, tungsten carbide, niobium, titanium, platinum, molybdenum or combinations thereof. The embodiment however, may first comprise the steps of cleaning the pocket and/or receptacle using steam, a chemical bath, a degreasing solvent, an abrasive cloth, stainless steel wire brush or combinations thereof, after which flux may be applied to help prevent oxides forming which could weaken the joint during and after heating. The pocket 450 and/or receptacle 440 may then be heated separately or together to at least 1200° F. before the two are bonded together using the filler 460. The channel 428 may allow air to enter or exit the receptacle 440 when the jack element 470 and/or pocket 450 is inserted or removed and prevent a suction effect. In some embodiments, the channel 428 may also be formed in the pocket, or just in the receptacle.

Figure 6:
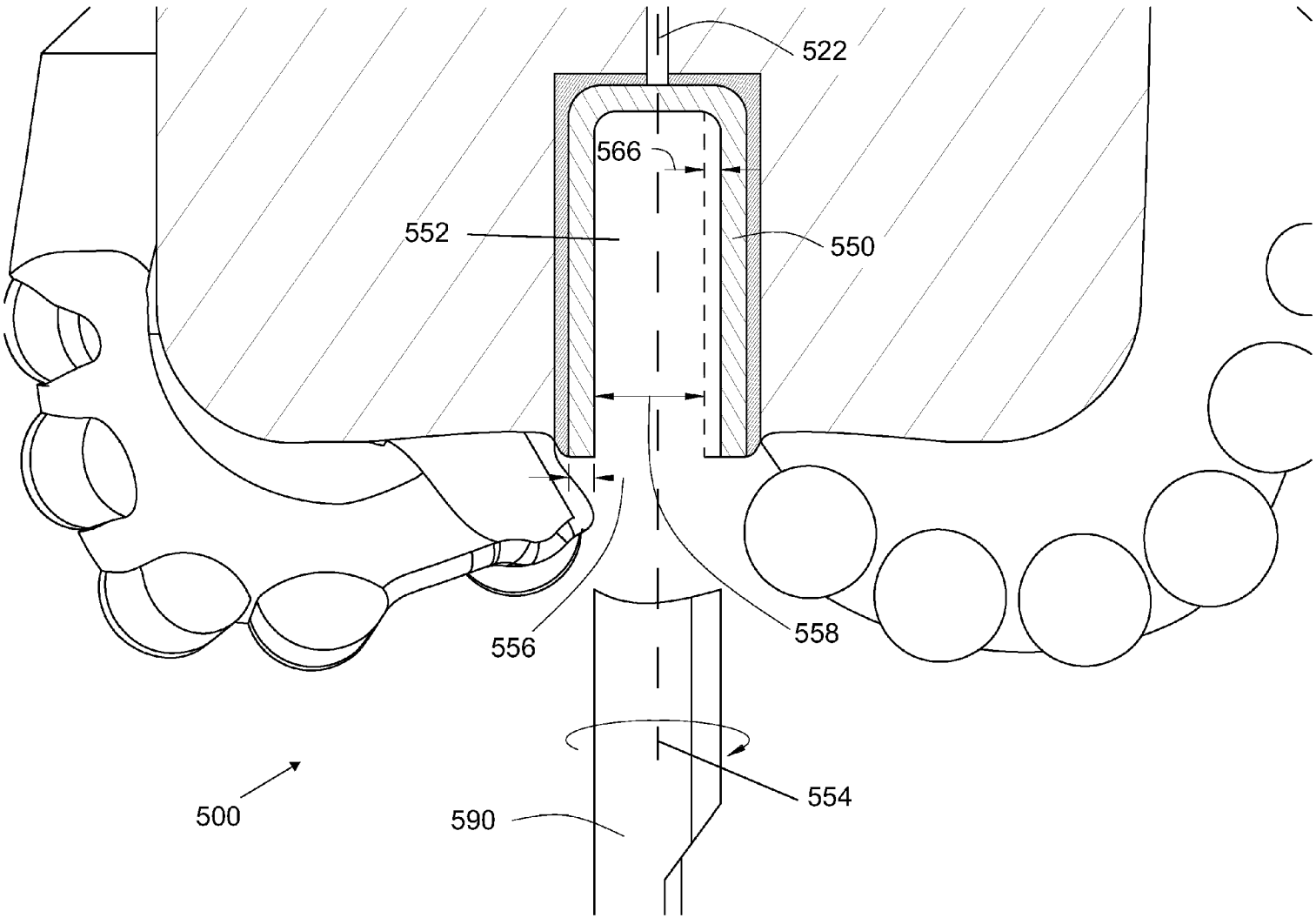
FIG. 6 is a cross sectional diagram of another embodiment of a drill bit assembly depicting a method of machining the pocket using a mill.

FIG. 6 discloses a cross section of an embodiment of the drill bit 500 having a pocket 550 with an annular thickness 556 preferably not less than 0.125 inches and an initial bore or central hollow 552 with an inner diameter 558 of preferably not less than 0.75 inches. The diagram further discloses an embodiment wherein a portion 566 up to 0.060 inches of the annular thickness 556 may be removed by a mill 590 or lathe (not shown) such that the centerline 554 of the resultant bore or central hollow 552 may be realigned to be substantially coaxial with the axis 522 of rotation of the drill bit 500 for receiving the jack element (not shown).

Figure 7:
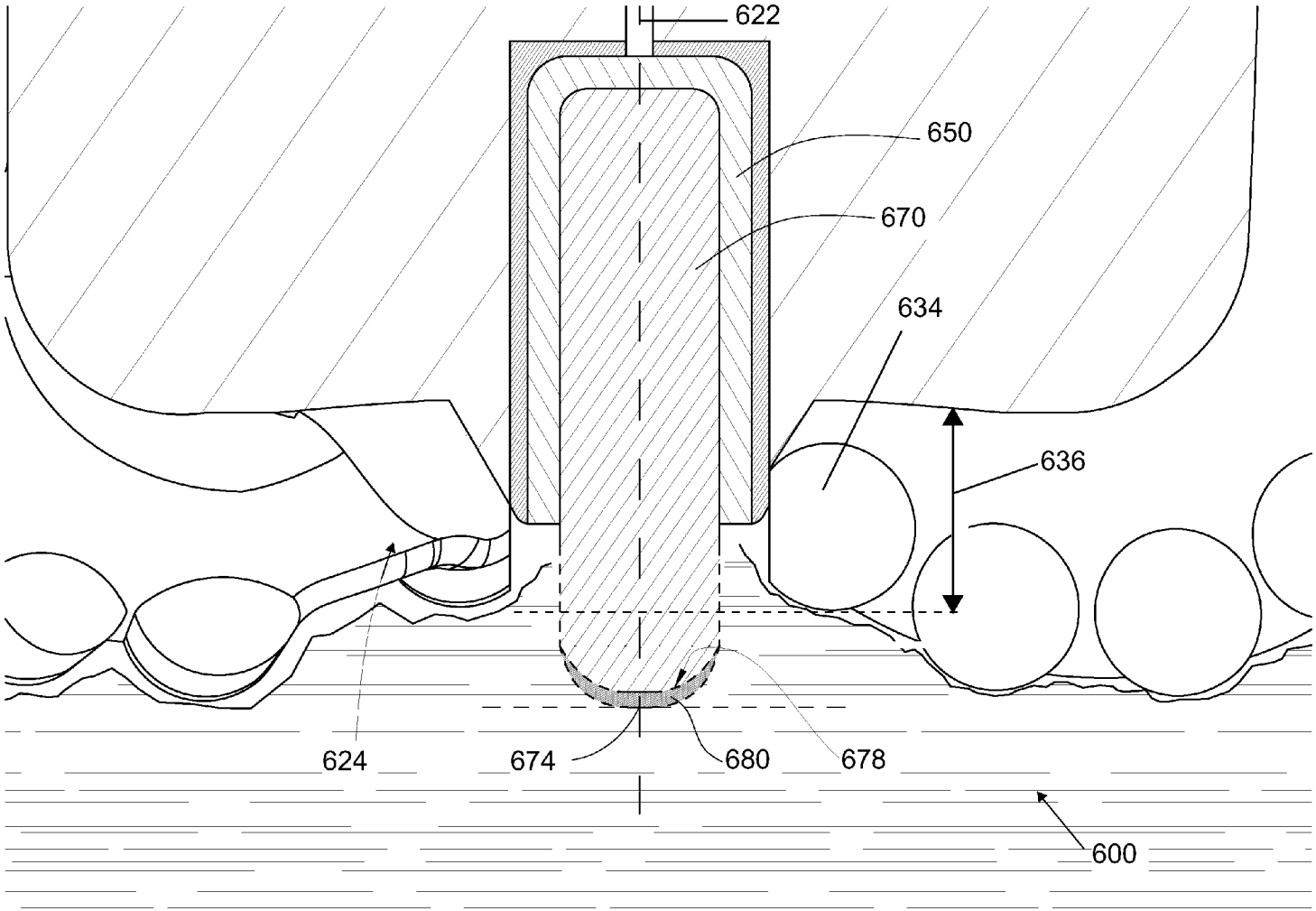
FIG. 7 is a cross sectional diagram of another embodiment of a drill bit assembly with a protruding jack element.

FIG. 7 discloses a cross section of an embodiment of the drill bit 600 having a jack element 670 that may be press fit into the pocket 650 such that the jack element protrudes from the working face 624. The jack element 670 may comprise an interference of between 0.0008 and 0.0050 inches with the bore or central hollow of the pocket 650. The embodiment also depicts the distal end 674 of the jack element 670 protruding 125% the height 636 of the at least one cutting element 634 that is disposed proximate the axis 622 of rotation of the drill bit 600, and comprise a domed, rounded, semi-rounded, conical, flat, or pointed geometry. In other embodiments however, the jack element 670 may protrude between 25% and 125% the height 636 of the one or more cutting elements 634 disposed proximate the axis 622 of rotation of the drill bit 600.

The distal end 674 of the jack element 670 may further comprise a generally non-planar interface 678 disposed between a layer or coating of abrasion resistant material 680. The abrasion resistant material may comprise a thickness of between 0.5 and 4.0 mm. The abrasion resistant material 680 may further comprise a material selected from the group of materials that includes natural diamond, polycrystalline diamond, boron nitride, tungsten carbide or combinations thereof, and which tend to display high wear resistant properties. In a preferred embodiment the abrasion resistant material 680 is sintered to the distal end 674 of the jack element 670; however the abrasion resistant material 680 may alternatively be brazed, press fit, welded, threaded or otherwise attached to the jack element 670.

Figure 8:
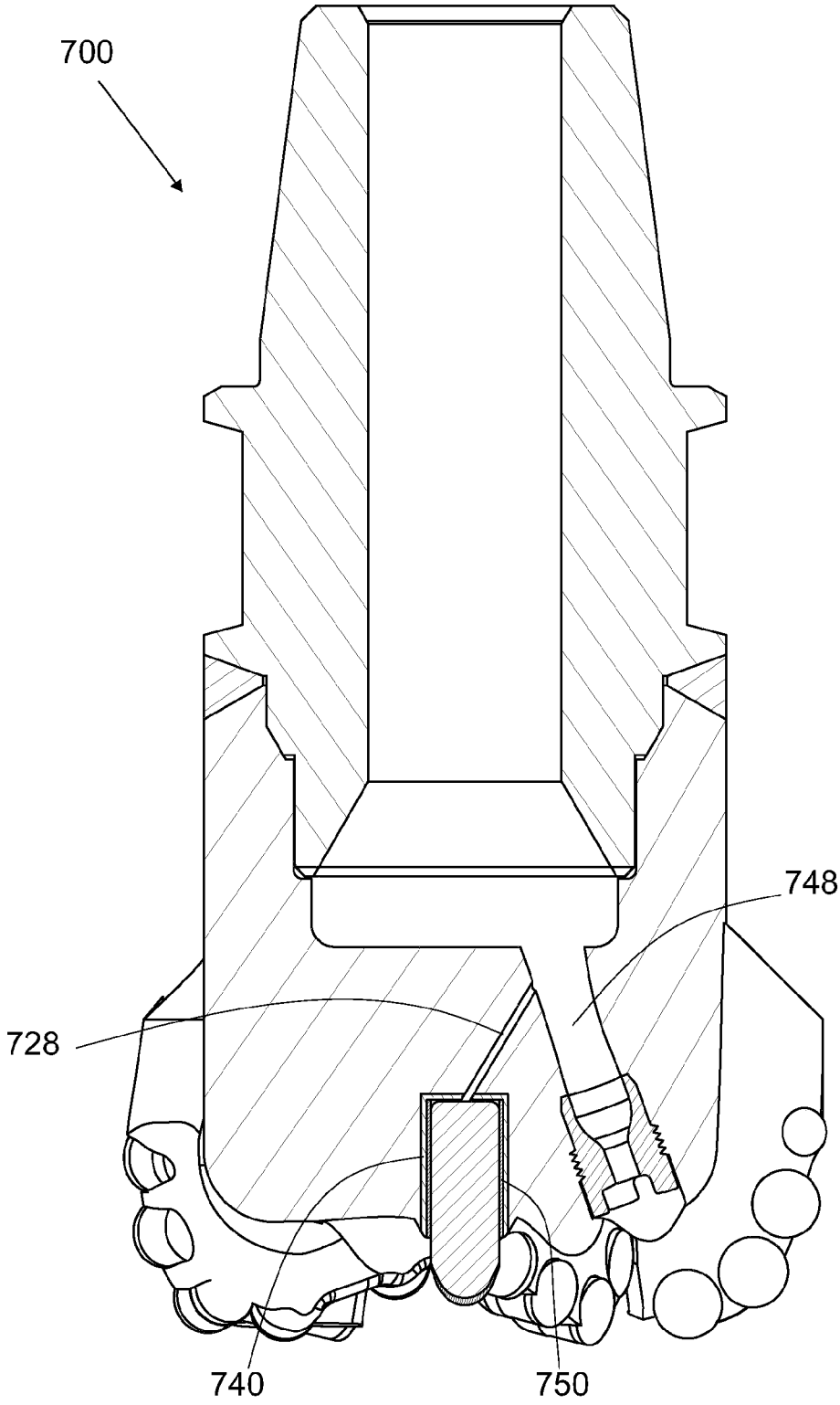
FIG. 8 is a cross sectional diagram of another embodiment of a drill bit assembly with a channel.

FIG. 8 discloses another embodiment of the drill bit 700 wherein the channel 728 may be formed to extend from the receptacle 740 and/or sleeve 750 into a portion of the nozzle chamber 748.

Figure 9:
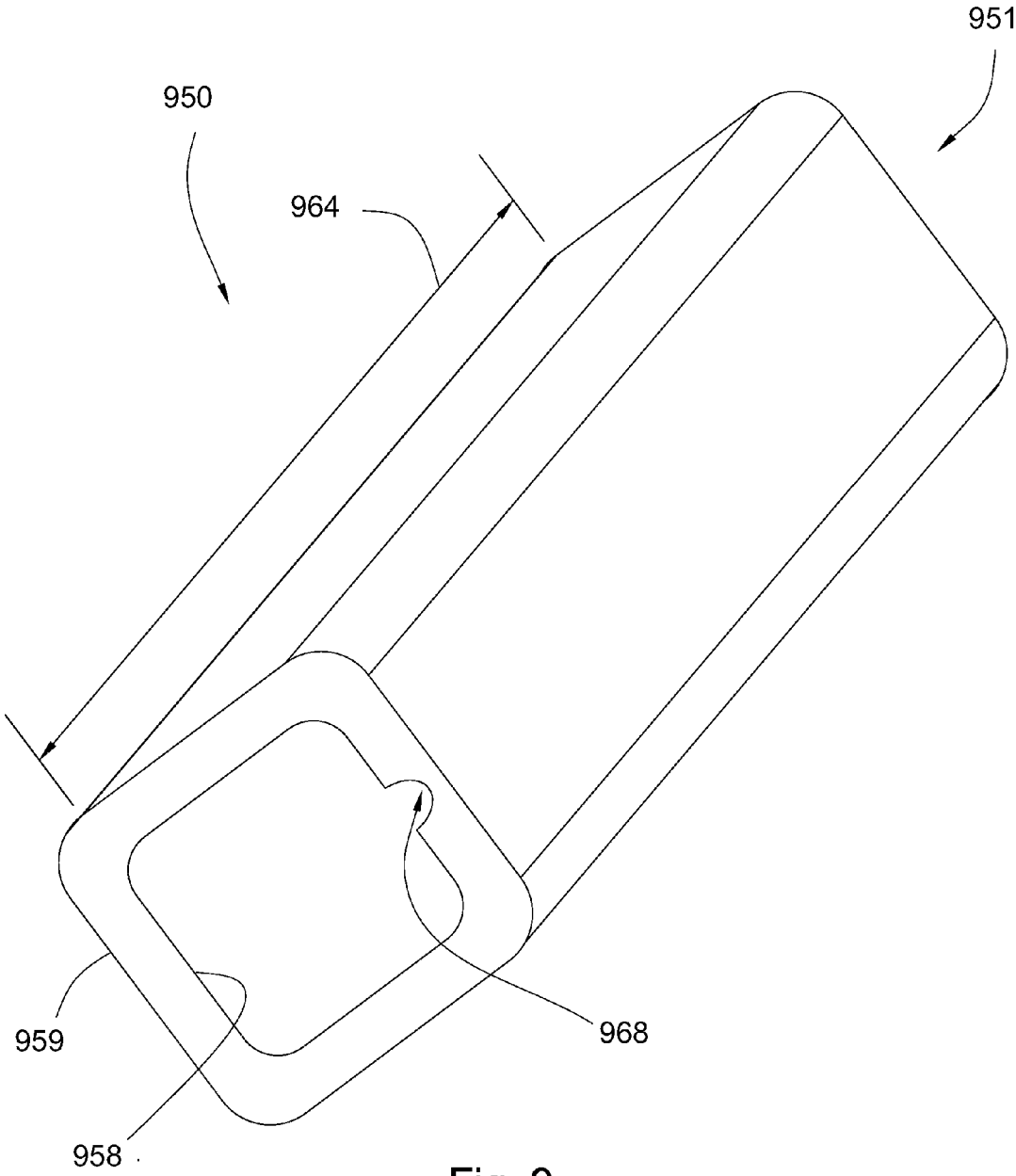
FIG. 9 is a perspective diagram of an embodiment of a pocket.

FIG. 9 is a perspective diagram of an embodiment of a polygonal pocket 950, which is adapted to receive a polygonal-shaped shaft of a jack element. A groove 968 is formed in the pocket 950 which allows the polygonal-shaft jack element to be press fit into the pocket without creating a suction effect. The groove 968 may run the entire length 964 of the pocket or just a portion of the length. In other embodiments, the groove may form a spiral. The polygonal pocket may be closed or open ended on a proximal end 951 of the pocket. The polygonal pocket 950 may be brazed, press fit, or otherwise attached into the receptacle of the working face of the bit. While the embodiment of FIG. 9 discloses a polygonal pocket 950 with an inner and outer diameter 958, 959 with generally polygonal shape, in some embodiments, only inner diameter 958 of the pocket comprises a generally polygonal shape, while in other embodiments only the outer diameter 959 of the pocket comprises a generally polygonal shape.

A jack element with a polygonal shaft (not shown) or a pocket 950 may be better adapted to resist torque produced during drilling. In some embodiments, a polygonal-shaft jack element may require a lesser press fit than a jack element with a more cylindrical shaft. In some embodiments, the pocket may comprise a more permanent attachment to the receptacle than the attachment of the jack element to the pocket, so that it is easier to replace the jack element without having to replace the pocket as well. In some embodiments, the pocket 950 may comprise a thread formed into the inner diameter of the pocket for easy installation and removal of the jack element. While the embodiment of FIG. 9 discloses a generally square polygonal shape, the generally polygonal shape may be generally triangular, hexagonal or other polygonal shapes.

Figure 10:
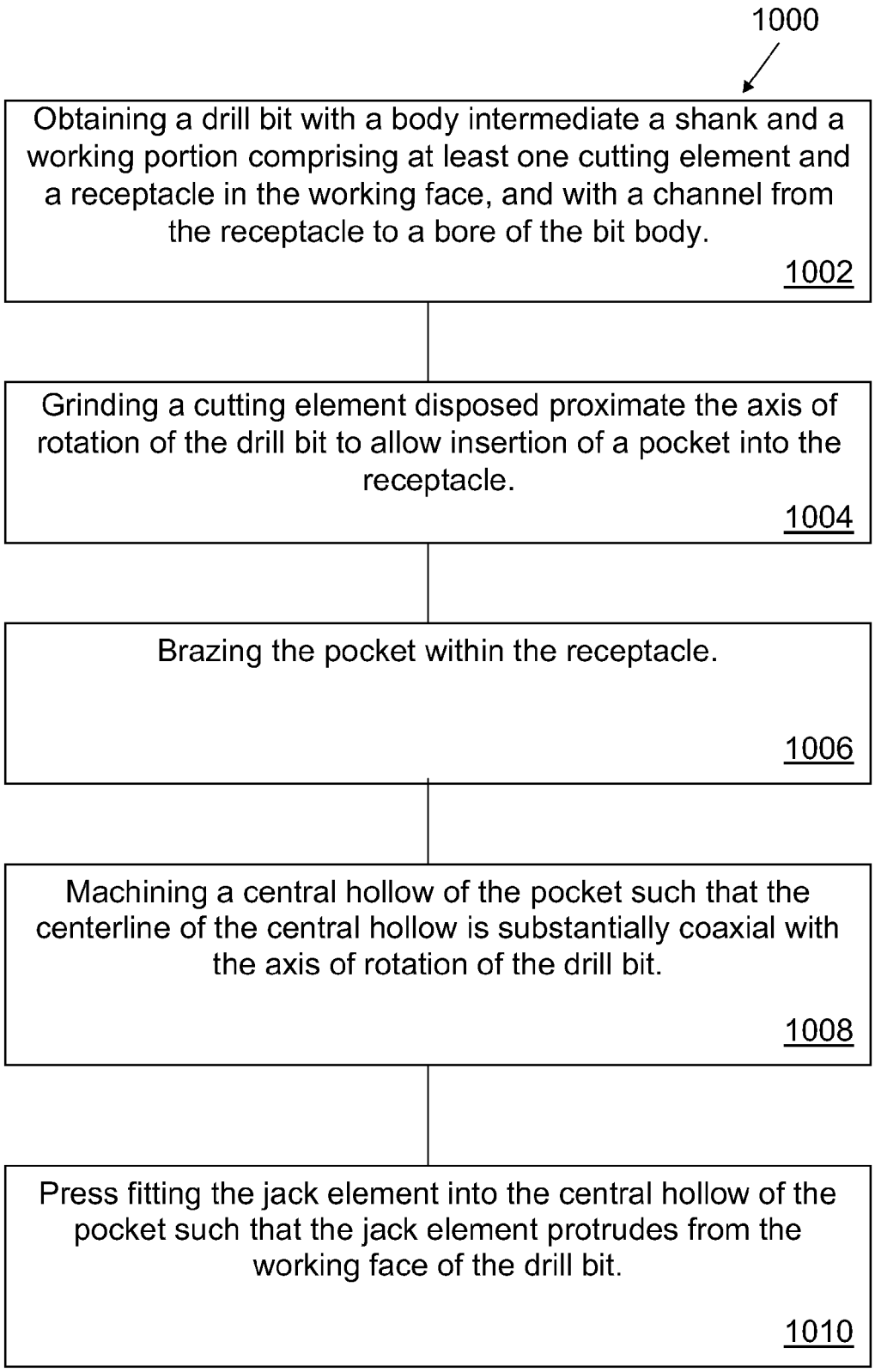
FIG. 10 is a diagram of a method for assembling a drill bit with a jack element.

FIG. 10 is a diagram of a method 1000 of assembling a drill bit with a jack element. The method comprises the steps of obtaining 1002 a drill bit with a body intermediate a shank and a working portion comprising one or more cutting elements and a receptacle in the working face, and with a channel extending from the receptacle to a bore of the bit body; grinding 1004 a cutting element disposed proximate the axis of rotation of the drill bit to allow insertion of a pocket into the receptacle; brazing 1006 the pocket within the receptacle; machining 1008 a central hollow of the pocket within the receptacle such that the centerline of the central hollow is substantially coaxial with the axis of rotation of the drill bit; and press fitting 1010 the jack element into the central hollow of the pocket such that the jack element protrudes from the working face of the drill bit.

Whereas the present invention has been described in particular relation to the drawings attached hereto, it should be understood that other and further modifications apart from those shown or suggested herein, ma be made within the scope and spirit of the present invention.

What is claimed is:

1. A method of assembling a drill bit with a jack element, comprising:

obtaining a drill bit that includes:

a shank; and a bit body attachable to said shank at a first end and having a working face at a second end opposite said first end, said working face including a receptacle formed proximate a center of said working face;

shaping said receptacle to substantially align a centerline of said receptacle with an axis of rotation of said drill bit;

attaching a pocket within said receptacle;

shaping a central hollow of said pocket to substantially align a centerline of said central hollow with said axis of rotation of said drill bit; and securing a jack element within said central hollow of said pocket such that said jack element is substantially coaxial with said axis of rotation of said drill bit.

2. A method of assembling a drill bit with a jack element, comprising:

obtaining a drill bit that includes:

a shank; and a bit body attachable to the shank at a first end and having a working face at a second end opposite the first end and a receptacle formed proximate a center of the working face;

attaching a pocket within the receptacle;

shaping a central hollow of the pocket to align a centerline of the central hollow with an axis of rotation of the drill bit; and securing a jack element within the central hollow of the pocket with a press fit such that the jack element is substantially coaxial with the axis of rotation of the drill bit.

3. The method of claim 2, further comprising forming a channel extending from an interior surface of the receptacle to a bore of the bit body.

4. The method of claim 2, further comprising forming a groove into an inner surface of the central hollow of the pocket.

5. The method of claim 2, wherein the receptacle formed into the working face is substantially coaxial with the axis of rotation before machining to accept the pocket.

6. The method of claim 2, wherein the working face further comprises at least one cutting element disposed proximate the axis of rotation.

7. The method of claim 6, wherein an outermost portion of the at least one cutting element proximate the axis of rotation extends a first distance from the working face, and wherein securing the jack element further comprises securing the jack element such that a distal end of the jack element extends a second distance from the working face that is between 25% and 125% greater than the first distance.

8. The method of claim 6, wherein the at least one cutting element is pre-flatted to allow insertion of the pocket into the receptacle.

9. The method of claim 8, further comprising grinding a portion of the at least one cutting element disposed proximate the axis of rotation to allow insertion of the pocket into the receptacle.

10. The method of claim 2, wherein a material forming the pocket is selected from the group consisting of aluminum, titanium, steel, mild steel, hardened steel, stainless steel and a metallic alloy.

11. The method of claim 2, wherein the pocket comprises an annular wall thickness not less than 0.125 inches.

12. The method of claim 2, wherein the central hollow of the pocket comprises a diameter not less than 0.75 inches.

13. The method of claim 2, wherein attaching the pocket within the receptacle comprises brazing the pocket into the receptacle.

14. The method of claim 13, wherein brazing the pocket into the receptacle further comprises brazing with a brazing alloy filler selected from the group consisting of copper, silver, nickel, aluminum, gold, tin, zinc, a refractory metal, carbide, tungsten carbide, niobium, titanium, platinum and molybdenum.

15. The method of claim 2, wherein the jack element comprises a material selected from the group consisting of gold, silver, a refractory metal, carbide, tungsten carbide, cemented metal carbide, niobium, titanium, platinum, molybdenum, diamond, cobalt, nickel, iron and cubic boron nitride.

16. The method of claim 2, wherein the press fit between the jack element and the central hollow of the pocket comprises an interference between 0.0020 and 0.0025 inches.

17. The method of claim 2, wherein a distal end of the jack element includes a layer of abrasion resistant material selected from the group consisting of natural diamond, polycrystalline diamond, boron nitride, and, tungsten carbide.

18. The method of claim 17, wherein the layer of abrasion resistant material comprises a thickness of 0.5 mm to 4.0 mm.

19. The method of claim 2, wherein the jack element includes a distal end having a domed, rounded, semi-rounded, conical, flat, or pointed geometry.

20. The method of claim 2, wherein the jack element comprises a polygonal shaft.

21. A method of assembling a drill bit with a jack element, comprising:

obtaining a drill bit that includes:

a shank; and a bit body attachable to said shank at a first end and having a working face at a second end opposite said first end, said working face including a receptacle formed proximate a center of said working face;

attaching a pocket having a central hollow within said receptacle;

shaping said central hollow of said pocket to align a centerline of said central hollow with an axis of rotation of said drill bit; and securing a jack element within said central hollow of said pocket such that a centerline of said jack element is substantially coaxial with said axis of rotation of said drill bit.

22. The method of claim 21, wherein said working face further comprises at least one cutting element disposed proximate said axis of rotation.

23. The method of claim 22, further comprising grinding a portion of said at least one cutting element to allow insertion of said pocket into said receptacle.

* * * * *